US007922548B2

(12) United States Patent
Fan

(10) Patent No.: US 7,922,548 B2
(45) Date of Patent: Apr. 12, 2011

(54) ELECTRICAL CONNECTOR HAVING FLOATABLY ARRANGED CONTACT

(75) Inventor: Chia-Wei Fan, Tu-Cheng (TW)

(73) Assignee: Hon Hai Precision Ind.Co., Ltd., New Taipei (TW)

( * ) Notice: Subject to any disclaimer, the term of this patent is extended or adjusted under 35 U.S.C. 154(b) by 0 days.

(21) Appl. No.: 12/838,514

(22) Filed: Jul. 19, 2010

(65) Prior Publication Data

US 2011/0014816 A1 Jan. 20, 2011

(30) Foreign Application Priority Data

Jul. 17, 2009 (CN) ..... 09 8 213109

(51) Int. Cl.
*H01R 4/48* (2006.01)

(52) U.S. Cl. ..... 439/862; 439/66; 439/733.1

(58) Field of Classification Search ..... 439/66, 439/71, 74, 862, 876, 733.1
See application file for complete search history.

(56) References Cited

U.S. PATENT DOCUMENTS

| | | | | |
|---|---|---|---|---|
| 6,217,342 | B1 * | 4/2001 | Neidich et al. | 439/66 |
| 6,908,316 | B2 | 6/2005 | Ma | |
| 6,929,483 | B2 * | 8/2005 | Huang et al. | 439/66 |
| 7,001,197 | B2 | 2/2006 | Shirai | |
| 7,291,021 | B2 | 11/2007 | Shirai | |
| 7,402,049 | B2 * | 7/2008 | Polnyi | 439/66 |
| 7,435,100 | B2 * | 10/2008 | Chang et al. | 439/66 |
| 7,455,556 | B2 * | 11/2008 | Mendenhall et al. | 439/862 |
| 7,503,770 | B2 * | 3/2009 | Fan | 439/66 |
| 7,563,105 | B2 * | 7/2009 | Liu et al. | 439/66 |
| 7,588,441 | B2 * | 9/2009 | Chang et al. | 439/66 |
| 7,614,883 | B2 * | 11/2009 | Mendenhall et al. | 439/66 |
| 2007/0298627 | A1 * | 12/2007 | Fan | 439/71 |
| 2008/0009151 | A1 * | 1/2008 | Fan | 439/71 |
| 2008/0050940 | A1 * | 2/2008 | Lin et al. | 439/66 |
| 2009/0247023 | A1 * | 10/2009 | Liao | 439/862 |

* cited by examiner

*Primary Examiner* — James Harvey

(74) *Attorney, Agent, or Firm* — Andrew C. Cheng; Wei Te Chung; Ming Chieh Chang

(57) ABSTRACT

An electrical connector includes a number of contacts and an insulative housing. Each contact includes a main body, a spring portion extending upwardly from the main body, and a tail portion defining a receiving space in a vertical plane. The insulative housing has a plurality of passageways retaining the contacts. An inner sidewall of each passageway has a protrusion extending into the receiving space to limit a movement of the contact, such that the contact can float upwardly and downwardly in the vertical direction without being drawn out of the passageway.

14 Claims, 5 Drawing Sheets

ELECTRICAL CONNECTOR HAVING FLOATABLY ARRANGED CONTACT

BACKGROUND OF THE INVENTION

1. Field of the Invention

The present invention relates to an electrical connector, and more particularly to an electrical connector having contacts with receiving mechanism moveably engaged with a portion of an insulative housing of the electrical connector such that each of the contacts can move upwardly and downwardly with respect to the housing so as to comply with an applied force.

2. Description of Related Art

U.S. Pat. No. 7,291,021 issued to Shirai et al. on Nov. 6, 2007 discloses an integrated circuit socket which comprises an insulative housing having an integrated circuit package receiving recess provided with a plurality of contact receiving openings arranged in a matrix. Contacts are arranged in the contact receiving openings. Each of the contacts has a base with a plurality of barbs on two opposite sides of the base. The barbs engage with inner walls of the opening to fix the contact in the opening. A contact arm extends away from the base and a contact portion with a contact point at an uppermost end. The contact portion overlaps with another contact arm of an adjacent contact. However, since the barbs intervene with the inner walls of the opening, the insulative housing may be damaged by the barbs.

In order to overcome the above-mentioned problem, another electrical connector is provided with contacts without barbs in openings of the insulative housing. The connector further includes a cover disposed on the insulative housing for receiving and limiting the contacts. Each contact comprises a retention portion, a spring portion extending upwardly from the retention portion, and a soldering portion extending downwardly from the retention portion. In assembly, the contacts are retained in the openings and the spring portion extends beyond the cover to contact with an electronic package. However, the cover of the above electrical connector makes the structure of the connector complex and increase steps of the assembling process, and not is compliance with the miniaturization of the electrical connector.

Therefore, an improved electrical connector is needed.

SUMMARY OF THE INVENTION

An object of the present invention is to provide a connector having contacts with receiving mechanism moveably engaged with a portion of an insulative housing of the electrical connector such that each of the contacts can move upwardly and downwardly with respect to the housing so as to comply with an applied force.

To achieve the aforementioned object, an electrical contact made in accordance with the present invention comprises an insulative housing defining at least a passageway with a protrusion extending from an inner wall of the passageway into the passageway, and at least a contact disposed in the passageway and with a tail portion sitting onto the protrusion.

To further achieve the aforementioned object, an electrical contact made in accordance with the present invention comprises a main body, a spring portion, and a tail portion. The spring arm extends upwardly from the main body. The tail portion includes a pair of legs. Each arm includes a seating arm extending horizontally from the main body, locking arm extending downwardly from the seating arm, and a tab disposed on inside of the locking arm.

Other objects, advantages and novel features of the invention will become more apparent from the following detailed description of a preferred embodiment when taken in conjunction with the accompanying drawings.

DETAILED DESCRIPTION OF THE INVENTION

Figure 1:
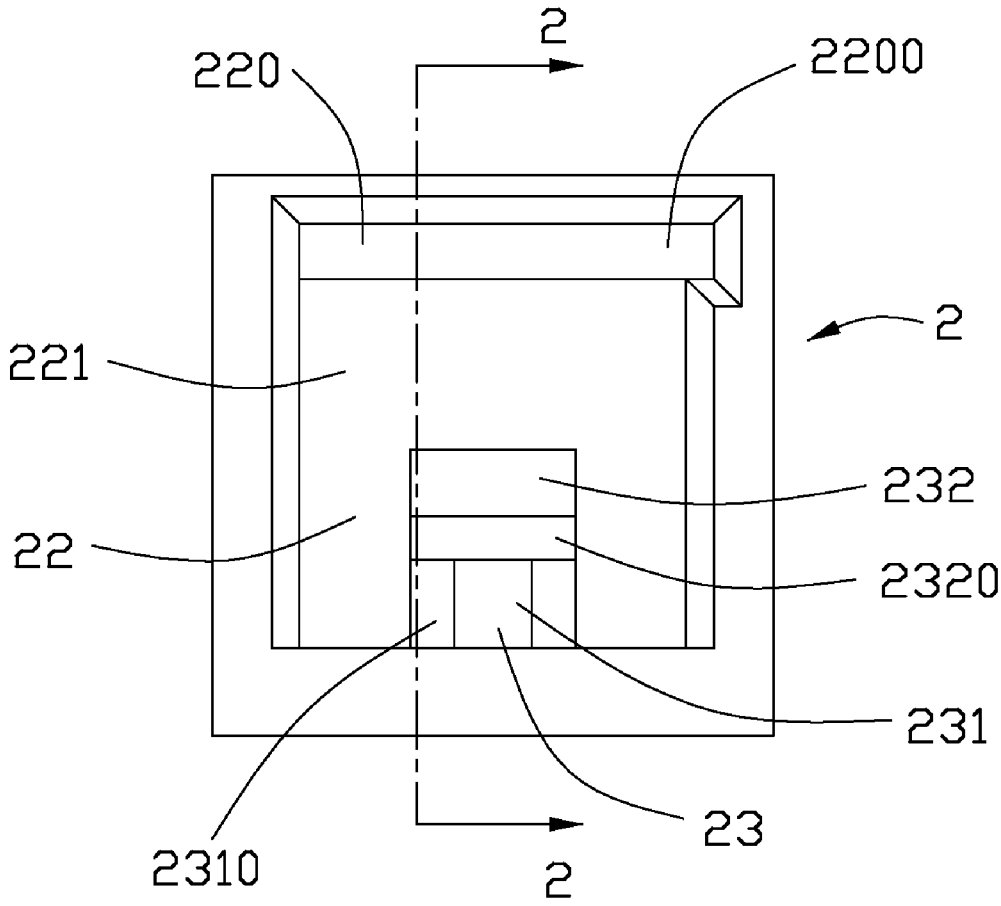
FIG. 1 is a top view of a passageway of an electrical connector in accordance with the present invention.
Figure 2:
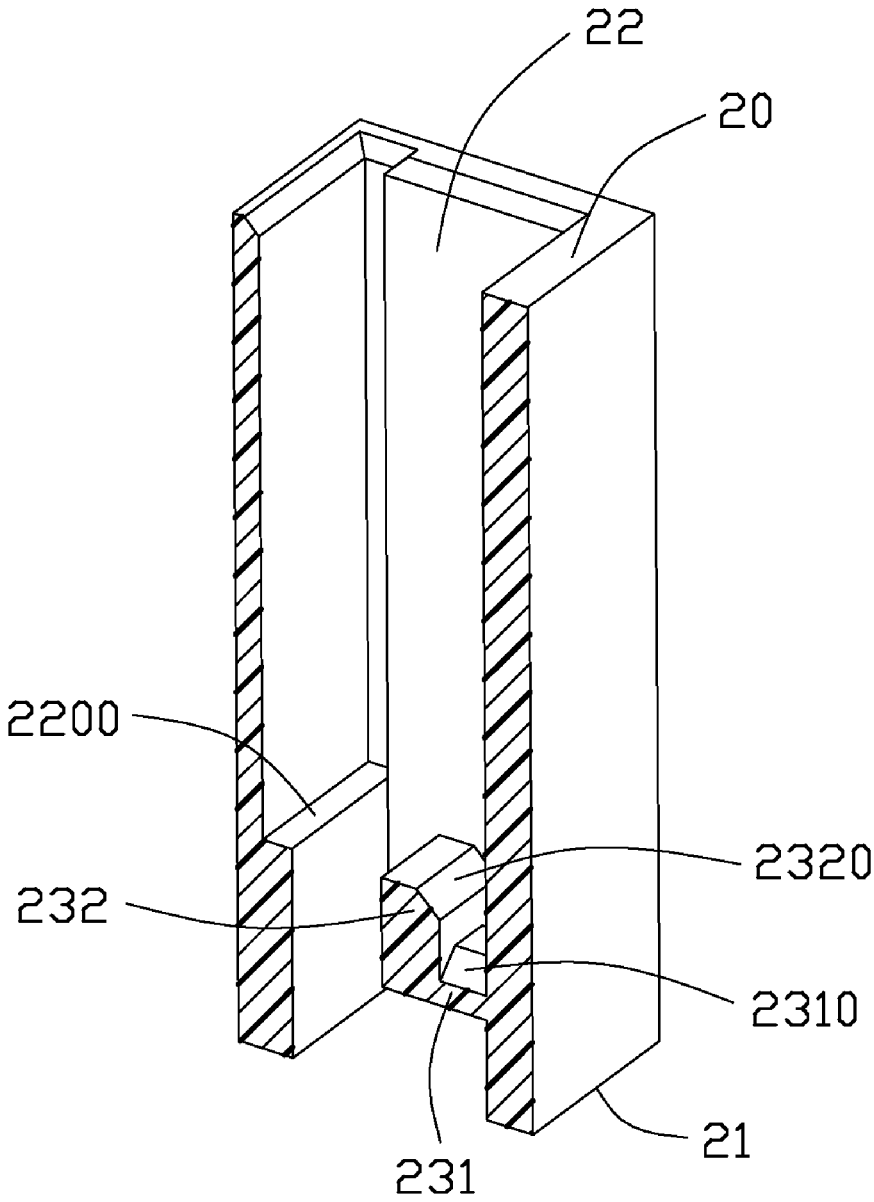
FIG. 2 is a cross-section view taken along line 2-2 of FIG. 1.

Referring to FIGS. 1 and 2, an electrical connector used for electrically connecting an electronic package (not shown) and a printed circuit board (not shown), comprises a plurality of contacts 1 (only one is shown for simplicity), an insulative housing 2 receiving the contacts 1 and a plurality of solder balls 3 attached to the contacts 1. Pertinent electrical connector in which the present invention can be applied is typically disclosed in U.S. Pat. Nos. 7,291,021, 7,001,197 and 6,908,316 which are herein incorporated for reference.

The insulative housing 2 includes a top surface 20, a bottom surface 21, and a passageway 22 extending through the top surface 20 and the bottom surface 21 for receiving the contact 1. The passageway 22 has a first recess 220 disposed on one side thereof and not passing through the insulative housing 2 so as to form a step 2200 on a bottom of the first recess 220 to support the contact 1. Each passageway 22 further has a second recess 221 passing through the insulative housing 2 and communicating with the first recess 220. As a matter of the fact, the first recess 220 defined by a side of the second recess 221 further extends outwardly. A protrusion 23 is disposed on a middle of an inner sidewall of the passageway 22 opposite to the step 2200. The protrusion 23 comprises a linking portion 231 extending firstly and then with a supporting portion 232 extending upward therefrom. A plurality of chamfers 2310, 2320 are disposed on two opposite sides of the linking portion 232 and a top edge of the supporting portion 232, these chamfers are beneficial for assembling of the contact 1 into the passageway 22. The step 2200 and the supporting portion 232 are substantially located at the same level for supporting the contact 1.

Figure 3:
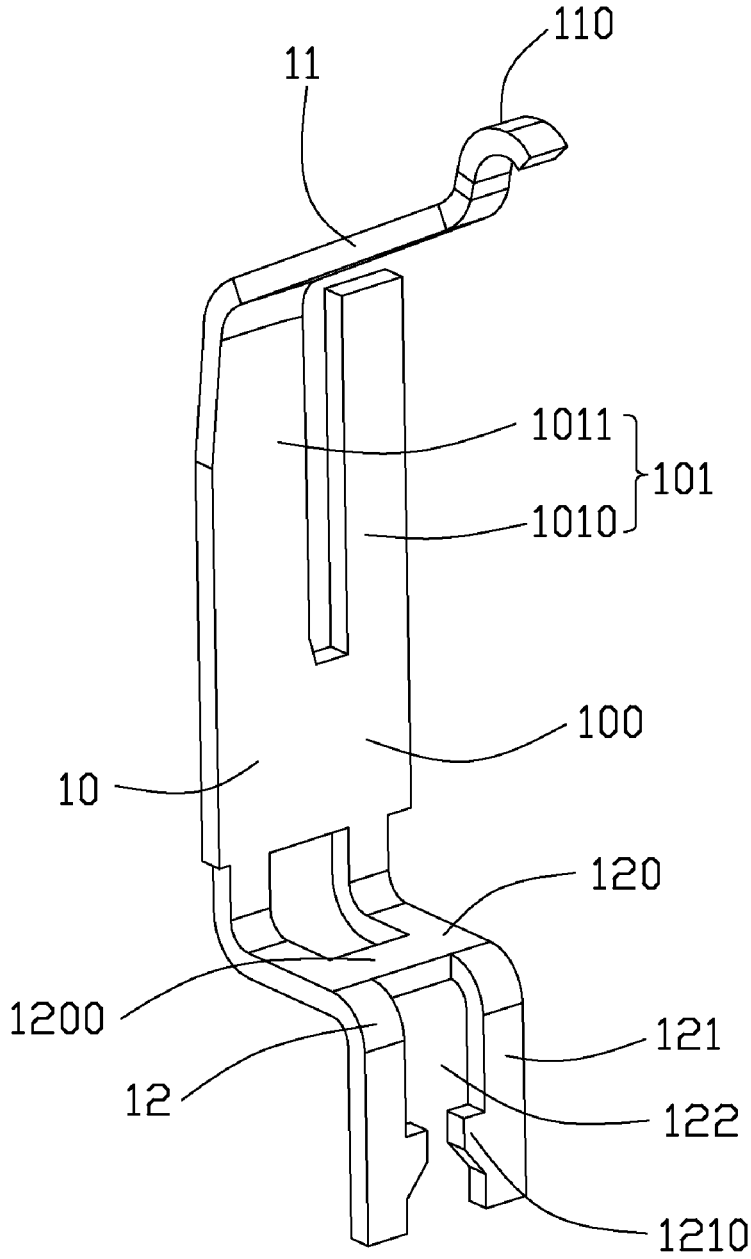
FIG. 3 is a perspective view of a contact of the electrical connector in accordance with the present invention.
Figure 4:
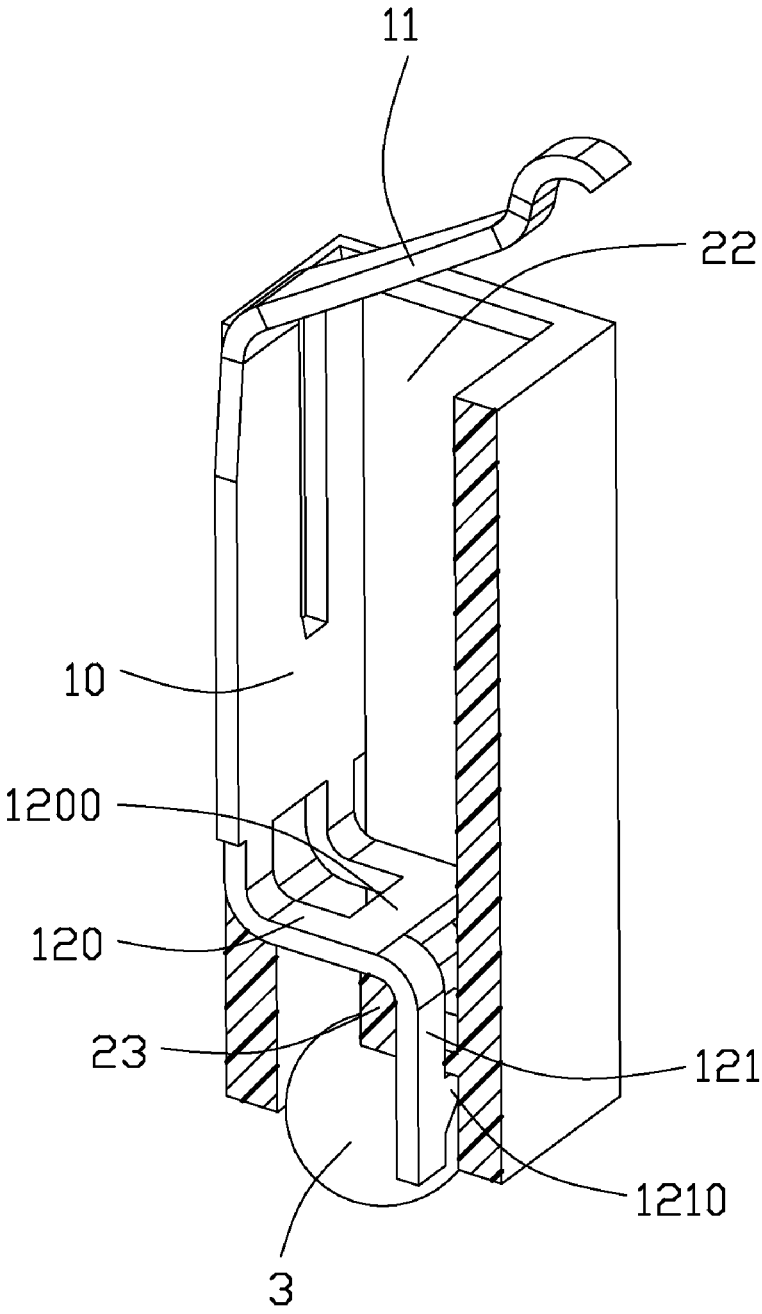
FIG. 4 is an assembled view of the electrical connector, showing the contact received in the passageway of the insulative housing.

Referring to FIGS. 3 and 4, the contact 1 includes a main body 10 retained in the first recess 221 of the passageway 22, a spring portion 11 extending upwardly from the main body 10, and a tail portion 12 extending downwardly from the main body 12. The main body 10 is formed as a board-like plate and comprises a first main body 100 and a second main body 101 located at top of the first main body 100. The second main body 101 comprises a first connecting portion 1010 and a second connecting portion 1011 spaced apart each other and with an equal height. The first connecting portion 1010 is used to connect with a carrier (not shown). The spring portion 11 extends aslant and upwardly from the second connecting portion 1011 and has a mating portion 110 at a top end thereof for mating with the electronic package (not shown). The tail portion 12 includes a pair of same legs. Each leg includes a seating arm 120 bent from the main body 10 and extending horizontally, and a locking arm 121 bent downwardly from an end of the seating arm 120. The seating arms 120 are connected with each other by a linkage arm 1200 which is seated on the supporting portion 232 of the protrusion 23 when the contact 1 is assembled to the insulative housing 2. A tab 1210 is disposed on an inside of each locking arm 121. A receiving space 122 is defined between the locking arms 121, the linkage arm 1200 for receiving the protrusion 23.

Figure 5:
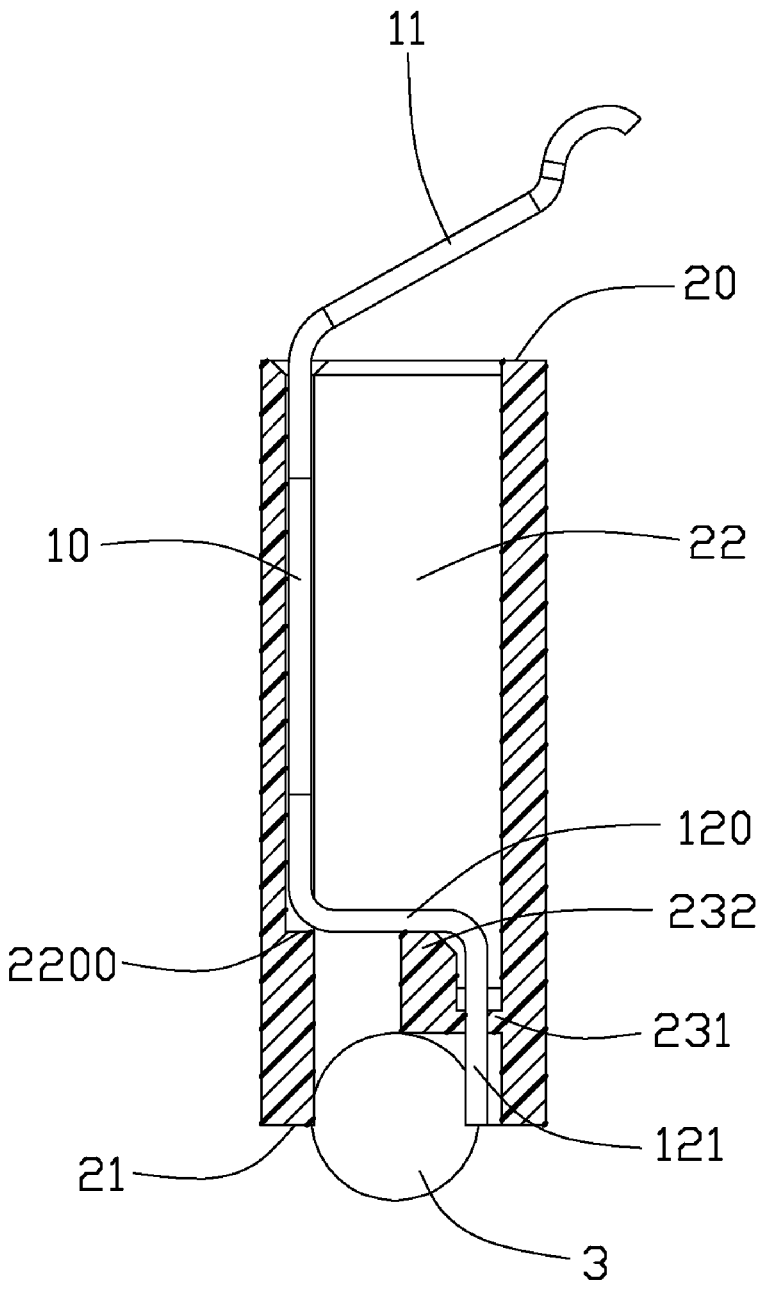
FIG. 5 is similar with FIG. 4, but taken from another side.

Referring to FIGS. 4 and 5, the contacts 1 are assembled into passageways 22 from the top surface 20 of the insulative housing 2. The two locking arms 121 of the tail portion 12 are opened outwardly to pass across the protrusion 23 and let the protrusion 23 enter the receiving space 122. At a final state, a part of the seating arms 120 of each contact 1 near the main body 10 seats on the step 2200, and the linkage arm 1200 seats on the supporting portion 232, so that the contact 1 will not drop out of the passageway 22 from the bottom surface 21 of the insulative housing 2; and the tabs 1210 are disposed under a bottom surface of the linking portion 231 to hold the linking portion 231 and prevent the contact 1 from pushing upwardly. The solder balls 3 are mounted into the passageways 22 from the bottom surface 21 of the insulative housing 2 and each is hold by the inner surfaces of the passageway 22 and the two locking arms 121. A bottom surface of the supporting portion 232 abuts against the solder ball 3 to limit the solder ball 3 to move upwardly. The tabs 1210 of the locking arms 121 can increase a mating surface between the contact 1 and the solder ball 3 so as to increase the holding force. In the present invention, a distance from a bottom surface of the seating arm 120 to the top surface of the tab 1210 in a vertical direction, in other word, a dimension of the receiving space 122 is in the vertical direction, is bigger than thickness of the linking portion 231, so the contact 1 can float upwardly and downwardly and have a good compliance.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining at least a passageway with a protrusion extending from an inner wall of the passageway into the passageway; and at least a contact disposed in the passageway and with a tail portion sitting onto the protrusion; wherein a main body of the contact is configured as a board-like plate; wherein the main body is received in the passageway and includes a first main body and a second main body extending from a top of the first main body, and the second main body comprises a first connecting portion and a second connecting portion.

2. An electrical contact comprising:

a main body;

a spring portion extending upwardly from the main body; and a tail portion including a pair of legs, each leg including a seating arm extending horizontally from the main body, a locking arm bent downwardly from the seating arm, and a tab disposed on an inside of the locking arm.

3. An electrical connector comprising:

an insulative housing defining a plurality of passageways extending therethrough in a vertical direction between upper and bottom surfaces of said housing;

each passageway defining a protrusion formed around a lower section thereof;

a plurality of contacts disposed in the corresponding passageways, respectively, each of said contacts defining a horizontal seating arm seated upon a top face of the corresponding protrusion, at least one locking arm extending downwardly with a tab latched to a bottom side of the corresponding protrusion, a main body linked to the seating arm and abutting against a side wall beside the corresponding passageway, and a resilient contact arm extending upward from the main body; and a plurality of solder balls each disposed in the lower section of the corresponding passageway under the corresponding protrusion and abutting against the locking arm.

4. The electrical connector as claimed in claim 3, wherein a spring portion extends upwardly and aslant from the second connecting portion, a curved mating portion is disposed at a tip of the spring portion.

5. The electrical connector as claimed in claim 1, wherein the tail portion includes a pair of substantially identical or matching legs.

6. The electrical connector as claimed in claim 1, wherein the tail portion includes a pair of seating arms extending horizontally from a main body, a pair of locking arms bent downwardly from ends of the seating arms, and a pair of tabs formed on an inside of each locking arm.

7. The electrical connector as claimed in claim 6, wherein the pair of seating arms are connected with each other by a linkage arm, which is seated on the protrusion.

8. The electrical connector as claimed in claim 7, wherein a receiving space is defined between the locking arms, the linkage arm, and the tabs, and the tab is disposed under the protrusion to limit the contact from upward movement.

9. The electrical connector as claimed in claim 7, wherein the protrusion comprises a linking portion extending horizontally and a supporting portion extending upwardly from the linking portion.

10. The electrical connector as claimed in claim 9, wherein a step is formed on a sidewall of the passageway opposite to the protrusion and seated by a part of the seating arms of each contact near the main body, and the linkage arm seats on the supporting portion.

11. The electrical contact as claimed in claim 2, wherein a receiving space is defined between the locking arms, a linkage arm, and the tabs.

12. The electrical contact as claimed in claim 2, wherein the seating arms are connected each other by a linkage arm.

13. The electrical contact as claimed in claim 2, wherein the main body is formed as a board-like plate.

14. The electrical contact as claimed in claim 13, wherein the spring portion extends upwardly and aslant from a top of the main body and has a curved mating portion disposed at a tip thereof.

* * * * *